US011833579B2

(12) United States Patent
Zhang

(10) Patent No.: US 11,833,579 B2
(45) Date of Patent: Dec. 5, 2023

(54) CASTING SLURRY

(71) Applicant: SAFRAN, Paris (FR)

(72) Inventor: Wen Zhang, Moissy-Cramayel (FR)

(73) Assignee: SAFRAN, Paris (FR)

( * ) Notice: Subject to any disclaimer, the term of this patent is extended or adjusted under 35 U.S.C. 154(b) by 0 days.

(21) Appl. No.: 16/648,896

(22) PCT Filed: Sep. 21, 2018

(86) PCT No.: PCT/FR2018/052318
§ 371 (c)(1),
(2) Date: Mar. 19, 2020

(87) PCT Pub. No.: WO2019/058071
PCT Pub. Date: Mar. 28, 2019

(65) Prior Publication Data

US 2020/0282452 A1 Sep. 10, 2020

(30) Foreign Application Priority Data

Sep. 22, 2017 (FR) ..... 1758793

(51) Int. Cl.

| | |
|---|---|
| ***B22C 1/02*** | (2006.01) |
| ***B22C 1/18*** | (2006.01) |
| ***B22C 9/04*** | (2006.01) |
| ***B22C 1/20*** | (2006.01) |

(52) U.S. Cl.
CPC ..... *B22C 1/02* (2013.01); *B22C 1/183* (2013.01); *B22C 1/205* (2013.01); *B22C 9/04* (2013.01); *B22C 1/186* (2013.01)

(58) Field of Classification Search
CPC ..... B22C 1/02; B22C 1/183; B22C 1/186; B22C 1/205; B22C 9/04
See application file for complete search history.

(56) References Cited

U.S. PATENT DOCUMENTS

| | | | | |
|---|---|---|---|---|
| 4,812,428 | A * | 3/1989 | Kohut | C04B 33/04 106/487 |
| 2005/0252634 | A1 | 11/2005 | Biramben et al. | |
| 2006/0081350 | A1 * | 4/2006 | Batllo | B22D 29/00 164/131 |
| 2006/0144550 | A1 | 7/2006 | Batllo et al. | |

FOREIGN PATENT DOCUMENTS

| | | | |
|---|---|---|---|
| CN | 1739882 | A | 3/2006 |
| CN | 1913991 | A | 2/2007 |
| CN | 102133614 | A | 7/2011 |
| CN | 106583652 | A | 4/2017 |

(Continued)

OTHER PUBLICATIONS

"Slip casting process for the manufacture of tubular alumina microfiltration membranes" to FALAMAK et al. Materials Science—Poland, vol. 27, No. 2, 2009.*

(Continued)

*Primary Examiner* — Shuangyi Abu Ali
(74) *Attorney, Agent, or Firm* — Oblon, McClelland, Maier & Neustadt, L.L.P.

(57) ABSTRACT

A casting slurry for the manufacture of shell molds, including powder particles and a binder, further including a surfactant. Use of such a casting slurry for the manufacture of a shell mold.

9 Claims, 1 Drawing Sheet

(56) References Cited

FOREIGN PATENT DOCUMENTS

| | | | |
|---|---|---|---|
| CN | 109843470 | A | 6/2019 |
| EP | 1 595 620 | A1 | 11/2005 |
| JP | 3122738 | B2 | 1/2001 |
| RU | 2098217 | C1 | 12/1997 |
| RU | 2625859 | C2 | 7/2017 |
| SU | 407623 | A1 | 12/1973 |
| SU | 1011323 | A1 | 4/1983 |
| SU | 1227310 | A1 | 4/1986 |
| SU | 1423249 | A1 | 9/1988 |

OTHER PUBLICATIONS

"Comparative study of different routes of particulate processing on the characteristics of alumina functionally graded microfilter/membrane supports" to FALAMAKI et al. vol. 280, Issues 1-2, Sep. 1, 2006, pp. 899-910.*

International Search Report dated Dec. 3, 2018 in PCT/FR2018/052318 filed on Sep. 21, 2018, 3 pages.

French Preliminary Search Report dated May 4, 2018 in French Application 1758793 filed on Sep. 22, 2017, 2 pages.

Mei, S. et al., "Optimisation of parameters for aqueous tape-casting of cordierite-based glass ceramics by Taguchi method," Materials Science and Engineering, A334, 2002, pp. 11-18, XP055472454.

Russian Office Action issued in Russian Patent Application No. 2020114216 dated Dec. 29, 2021 (English translation).

Brazilian Office Action issued in Brazilian Patent Application No. 11 2020 005634 0 dated Jul. 26, 2022, (w/ English Translation).

* cited by examiner

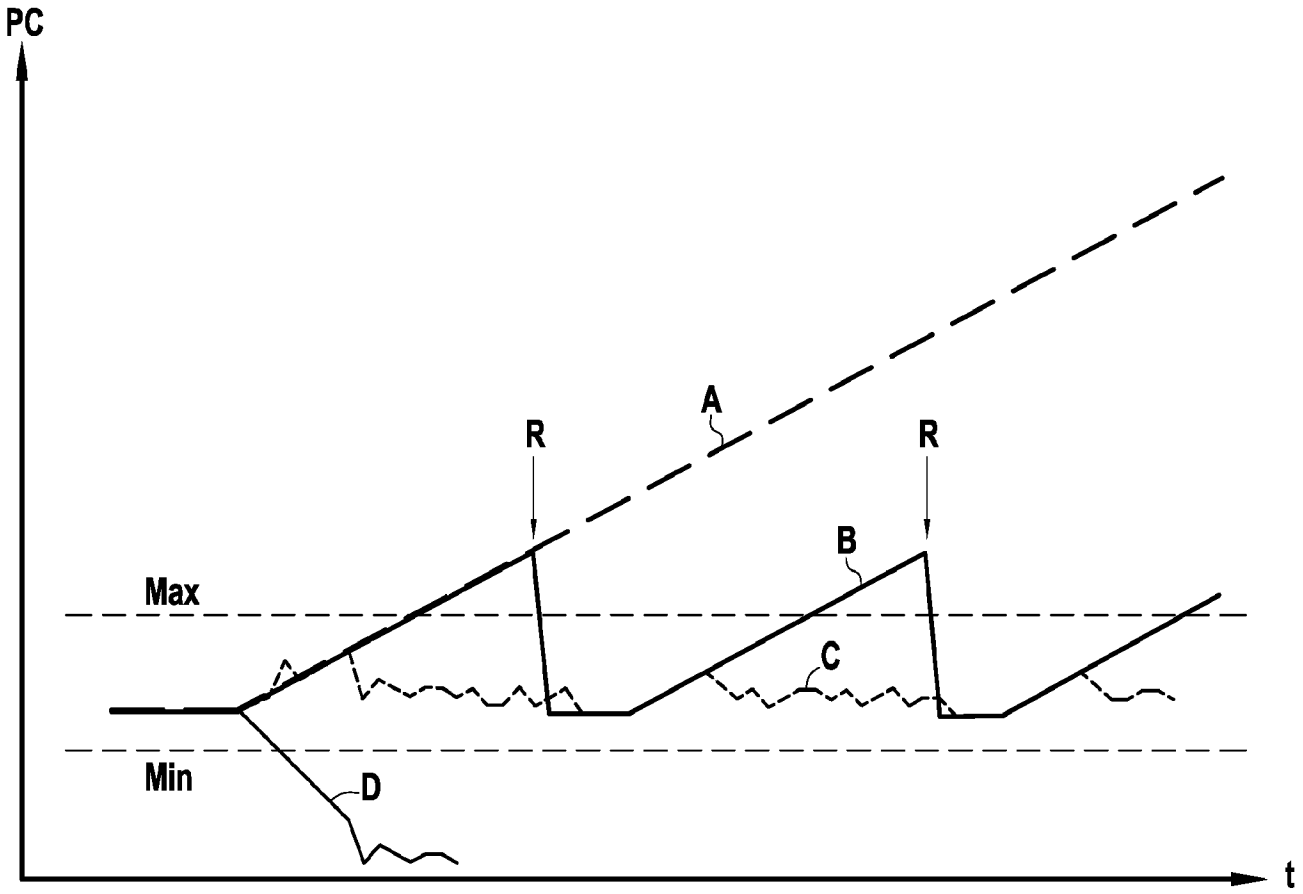
PC
t
Max
Min
A
B
C
D
R
R

CASTING SLURRY

FIELD OF THE INVENTION

The present disclosure relates to the field of the casting, in particular the lost-wax casting processes, and more particularly the slurries used in such processes, especially for the manufacture of casting shell molds.

PRIOR ART

Casting processes known as lost-wax or lost-pattern casting have been known, in themselves, since antiquity. They are particularly suitable for the production of metal parts with complex shapes. For example, lost-wax casting is used in particular for the production of turbine engine blades or rotor blade sectors. In the lost-wax casting process, the first step is normally the manufacture of a shell mold, which usually involves making a pattern from a material with a comparatively low melting temperature, such as wax or resin, around which a shell of refractory material is then made. After destruction of the pattern, usually by evacuation of the pattern material from the interior of the shell mold, which gives these processes their name, a molten metal is poured into this mold, in order to fill the cavity formed by the pattern in the mold after its evacuation. Once the metal cools and solidifies, the mold can be opened or destroyed in order to recover a metal part conforming to the shape of the pattern.

To make the shell mold, the wax pattern is usually dipped in a casting slurry, then coated with sand and dried. These operations can be repeated in order to form several layers and obtain the desired thickness and mechanical strength of the shell mold.

In practice, casting slurries are manufactured in large amounts to be used over several months, but their properties deteriorate over time, which affects the quality of the shell molds. A known method of counteracting this degradation is to regenerate the slurry by diluting old slurry with a more recently manufactured slurry, which partially restores the properties of the slurry. However, this method results in significant fluctuations in properties, its effects are short-lived, and a significant proportion of the old slurry is discarded.

Alternatively, some additives may have been used, but none of these additives have been satisfactory to the extent that the improvement in one parameter of the slurry was offset by unacceptable degradation of another parameter.

There is therefore a need for a new type of casting slurry with increased stability over time.

PRESENTATION OF THE INVENTION

For this purpose, the present disclosure relates to a casting slurry for the manufacture of shell molds, comprising powder particles and a binder, characterized in that it comprises a hiding power stabilizing surfactant.

A casting slurry is a slurry suitable for use in the formation of a shell mold into which molten metal is poured. In particular, by difference with any suspension, such a slurry comprises a binder, i.e. a compound ensuring cohesion between the powder particles and giving the shell mold its mechanical strength when unfired and after sintering. The binder may be inorganic. Examples of binders will be given below. Classically, the powder particles can be sand particles (also known as "flour"), especially refractory particles, generally having a diameter between 1 micrometer and 100 micrometers.

A surfactant, also known as a surface agent, is a compound that modifies the surface tension between two surfaces, for example between two compounds in a mixture. Surprisingly, the inventor found that the addition of a particular surfactant to a casting slurry significantly stabilized the slurry's hiding power, i.e. its ability, measured in mass per unit area, to remain on a given surface after soaking and draining. Conversely, the hiding power of a slurry of the prior art, without a hiding power stabilizing surfactant, tends to increase over time without stabilizing.

Some surfactants are known as dispersing agents to fluidize certain suspensions, but for these suspensions, they do not stabilize the hiding power due to the absence of binder. Conversely, in the slurry of the present disclosure, the hiding power stabilizing surfactant modifies the interaction between the binder and the powder particles to stabilize the hiding power of the slurry. Generally, compounds previously used as fluidizing or dispersing agents have had no effect on hiding power.

In addition, the surfactant also stabilizes the viscosity of the slurry.

Thus, the slurry according to the present disclosure has a composition with key parameters (viscosity, pH, density, etc.), in particular hiding power, which are stable over time, thus improving the repeatability of the shell mold manufacturing process and considerably limiting the amount of waste associated with the traditional regeneration of the slurry.

In some embodiments, the surfactant has a carbon chain comprising at most four thousand eight hundred carbon atoms, preferably at most two thousand carbon atoms, preferably still at most one thousand carbon atoms, preferably still at most five hundred carbon atoms, preferably still at most one hundred carbon atoms. This prevents the slurry from thickening, as the binder molecules could become entangled in a carbon chain that is too long.

In some embodiments, the surfactant does not include ammonia ions. As ammonia ions tend to cause the binder to gel, the use of such a surfactant further stabilizes the slurry.

In some embodiments, the surfactant leaves the pH of the slurry unchanged to within ±5%. In other words, the pH of the slurry is changed by less than ±5% before and after the surfactant is added. This keeps the slurry compatible with the other specifications of the shell mold manufacturing process.

In some embodiments, the surfactant includes Tiron $C_6H_4Na_2O_8S_2$. Preferably, the surfactant is Tiron. Tiron, in addition to meeting the above criteria, is a relatively common molecule, generally used as an indicator of complexometry, in analytical chemistry, to reveal the presence of certain ions, or as a dispersant.

Alternatively or in addition, in certain embodiments, the surfactant comprises sodium polyacrylate. Sodium polyacrylate has the generic formula [—CH2-CH(COONa)-]n. Preferably, the surfactant is sodium polyacrylate.

In some embodiments, the binder is chosen from: ethyl silicate, sodium silicate or colloids, including, in particular, colloidal silica, colloidal alumina, colloidal yttria or colloidal zirconia.

In some embodiments, the mass content of the surfactant in the slurry is less than 0.1%, preferably less than or equal to 0.05%. A small amount of surfactant is therefore sufficient to stabilize the casting slurry, particularly its hiding power. Conversely, an excessive amount of the hiding power stabilizing surfactant may cause the hiding power to vary too greatly. As a result, the composition of the slurry is essentially unchanged. This makes it possible to keep a slurry compatible with the other specifications of the shell mold manufacturing process.

In some embodiments, the slurry is a contact slurry configured to come into contact with a pattern of a wax part or equivalent. The first slurry used, which directly covers said pattern, is called a contact slurry, as opposed to the following slurries, which are called reinforcing slurries and cover the previous layers of the shell mold being formed. A contact slurry is configured to conform to the shape of the pattern and not to alter it. A contact slurry is often held for longer periods of time than a reinforcing slurry, which is consumed more rapidly, thus increasing the need for stability in a contact slurry.

In some embodiments, the powder particles comprise at least one compound among alumina, mullite, zircon, zirconia, silica, mullite-zirconia composites. Mullite refers to silico-aluminous materials.

The present disclosure also relates to the use of a casting slurry as previously described for the manufacture of a shell mold.

BRIEF DESCRIPTION OF THE DRAWINGS

The invention and its advantages will be better understood upon reading the following detailed description of embodiments of the invention given by way of non-limiting examples. This description refers to the appended drawings, in which the single FIGURE is a graph illustrating the change in the hiding power of different slurries as a function of time.

DETAILED DESCRIPTION OF EMBODIMENTS

In order to assess the addition of a surfactant to a casting slurry, the inventor first studied a control slurry, denoted slurry A, intended to be used as a contact slurry for the manufacture of a shell mold. Slurry A may have the following composition, expressed in percentages by mass:

binder (colloidal silica): 29.8%;

powder particles (mullite-zirconia composite): 70.0%;

wetting agent, anti-foaming agent and other additives: 0.2%.

This mass distribution is given here by way of example, with the understanding that a variation of the mass distribution between 0.1% and 10% is possible. Slurry A has a basic pH value and does not comprise, even among the above-mentioned "other additives", any surfactant having an effect on the hiding power.

In addition, as mentioned above, the inventor studied a slurry C, which was prepared by taking slurry A and adding a hiding power stabilizing surfactant, in this case Tiron, at a mass content of 0.05%, preferentially 0.005%. The resulting casting slurry C is therefore also a contact slurry. The amount of Tiron can be adjusted by the skilled person according to the initial hiding power and the desired hiding power, preferably not exceeding 0.1% by mass. For example, the mass content of Tiron may be less than or equal to 0.08%, preferably less than or equal to 0.05%, preferably less than or equal to 0.02%, and preferably still less than or equal to 0.01%.

The inventor verified that the addition of Tiron to the slurry hardly changed its pH, i.e. by a value less than or equal to plus or minus 5%. In addition, Tiron has a short carbon chain, comprising less than one hundred carbon atoms, in this case six carbon atoms. Tiron does not comprise ammonia ions as it does not comprise nitrogen at all. Tiron is also a good complexing agent for the chemical elements of the oxides present in slurry C and coming from the powder particles; in fact, Tiron has affinities with these oxides and can effectively interact with them. Furthermore, Tiron will be eliminated during the heat treatment of the corresponding shell mold and has no harmful effect on the metal of the part to be cast in the shell mold.

Thus, by its interaction with the oxides and colloidal silica forming the binder, the surfactant, here Tiron, ensures good stability of slurry C, particularly its hiding power, as will be seen in reference to the single FIGURE.

This FIGURE shows the change in the hiding power HP of four slurries as a function of time t. Coverage can be measured in grams per square centimeter ($g/cm^2$) and time in days. To measure the hiding power of a slurry, a wax pattern or an object having an equivalent surface state having a predetermined shape is dipped into said slurry for a first predetermined time, typically 10 seconds, and then drained for a second predetermined time, typically 120 seconds. The hiding power is then calculated as the difference in mass of the pattern before and after dipping, relative to the surface of the pattern. The hiding power is highly dependent on the composition of the pattern, the composition of the slurry and the times used in the calculation method, which is why the exact values have not been shown in the single FIGURE, only the comparative change being representative.

The four slurries compared on the single FIGURE are on the one hand the slurries A and C described above and whose change is represented respectively by curves A and C, and on the other hand a slurry B whose change is represented by curve B and a slurry D whose change is represented by curve D. Slurry B has an initial composition identical to slurry A but differs from slurry A in that it undergoes regeneration at times R. Regeneration consists in removing part of slurry B and diluting the remaining part in a freshly prepared slurry. The slurry can be diluted in a proportion between 10 and 50%, for example 20%. Such an operation is known per se.

Slurry D has an initial composition identical to slurry C, except for the mass proportion of Tiron which is 0.1%.

The four casting slurries A, B, C, D were kept stirred throughout the measurements. The hiding power of the slurries must remain between a lower limit Min and an upper limit Max, shown in the single FIGURE, to meet the desired technical specifications. The amplitude of the interval between the Min and Max limits may be about 5 to 10% of the target hiding power.

As represented by the long-dashed curve A, slurry A sees its hiding power increase continuously over time, until it exceeds the upper limit Max and never falls below it again. This slurry, which behaves in accordance with the prior art, is not satisfactory from the point of view of hiding power.

As represented by the bold-line curve B, slurry B, regularly regenerated, has a hiding power that remains mostly in the desired Min-Max range. However, even apart from the processing and pollution constraints imposed by regeneration, its hiding power exhibits significant fluctuations which affect the characteristics of the contact layer of the shell mold and, consequently, the surface quality of the part cast in said mold.

As represented by the short-dotted curve C, slurry C, comprising a surfactant as indicated above, has a relatively stable hiding power, the small variations observed being due to the deviation of the measurement and/or to the addition of water to compensate for the losses by progressive evaporation of the water contained in the colloidal silica. Neither Tiron nor other agents were added during the tests, after the initial addition of Tiron to slurry C.

As represented by the fine-line curve D, slurry D, comprising a hiding power stabilizing surfactant in an amount greater than or equal to 0.1% by mass, has a hiding power below the minimum limit Min, thus too low in relation to the specifications of the slurry.

In addition, it was found that Tiron also had an influence as a dispersing agent, making the slurry more fluid and improving the dipping of the patterns during the manufacture of the molds. This improves the slurry coverage of enclosed or less accessible areas.

As can be seen from the single FIGURE, slurry C, comprising a surfactant and more particularly Tiron, has a considerably longer service life thanks to the stabilization of its hiding power. Adding a surfactant to a casting slurry is inexpensive and simple to process. This type of casting slurry therefore makes it possible, at lower cost, to better control the manufacturing parameters of shell molds, process costs, to reduce industrial waste and to simplify the use of the slurries.

Surfactants other than Tiron could be used to stabilize a casting slurry, for example sodium polyacrylate of the generic formula [—CH2-CH(COONa)-]n.

Instead of colloidal silica, the slurry could comprise another binder, for example selected from: ethyl silicate, soda silicate or colloids comprising, in particular, colloidal alumina, colloidal yttria or colloidal zirconia.

Instead of or in addition to the mullite-zirconia composite, the slurry could comprise other powder particles selected from alumina, mullite, silica, zircon, zirconia, all alumino-silicate-based materials and mixtures thereof.

According to one alternative, instead of including Tiron in the initial composition of slurry C, it is possible to add it during the use of the slurry.

Casting slurry C can be used to make a shell mold. For this purpose, a pattern of the part, typically made of wax, can be dipped in casting slurry C and then drained, covered with sand and dried. These operations can be repeated afterwards, preferably with another slurry acting as a reinforcing slurry.

Although the present invention has been described with reference to specific embodiment examples, modifications may be made to these examples without going beyond the general scope of the invention as defined by the claims. In particular, individual features of the different embodiments illustrated/mentioned may be combined in additional embodiments. Therefore, the description and drawings should be considered in an illustrative rather than restrictive sense.

The invention claimed is:

1. A casting slurry for manufacturing shell molds, comprising: powder particles including at least one of alumina, mullite, zircon, zirconia, mullite-zirconia composites, an alumino-silicate-based material and mixtures thereof, a mass content of the powder particles in the casting slurry being between 60% and 80%; a binder selected from ethyl silicate, sodium silicate or colloids, a mass content of the binder in the casting slurry being between 19.8% and 39.8%; and Tiron $C_6H_4Na_2O_8S_2$ as a surfactant, wherein a mass content of said surfactant in the casting slurry is less than 0.05%, wherein a sum of the mass content of the powder particles and the mass content of the binder is greater than 99% and less than 99.9%, and wherein the casting slurry is configured to retain a sand coating on a pattern.

2. The casting slurry as claimed in claim 1, wherein the surfactant leaves a pH of the casting slurry unchanged to within 5%.

3. The casting slurry as claimed in claim 1, wherein the mass content of the surfactant in the casting slurry is less than or equal to 0.01%.

4. The casting slurry as claimed in claim 1, wherein the casting slurry is a contact slurry configured to come in contact with a part pattern.

5. A method of manufacturing a shell mold, comprising using a casting slurry as claimed in claim 1.

6. The casting slurry as claimed in claim 1, wherein the colloids include colloidal silica, colloidal alumina, colloidal yttria or colloidal zirconia.

7. The casting slurry as claimed in claim 1, wherein the casting slurry is configured to conform to a shape of the pattern.

8. The casting slurry as claimed in claim 1, wherein the mass content of the surfactant in the casting slurry is less than or equal to 0.005%.

9. The casting slurry as claimed in claim 1, further comprising a wetting agent distinct from the surfactant.

* * * * *